US009158273B2

(12) United States Patent
Tanaka

(10) Patent No.: US 9,158,273 B2
(45) Date of Patent: Oct. 13, 2015

(54) IMAGE FORMING APPARATUS

(71) Applicant: CANON KABUSHIKI KAISHA, Tokyo (JP)

(72) Inventor: Shigeru Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/150,088

(22) Filed: Jan. 8, 2014

(65) Prior Publication Data

US 2014/0119754 A1 May 1, 2014

Related U.S. Application Data

(62) Division of application No. 13/106,186, filed on May 12, 2011, now Pat. No. 8,666,269.

(30) Foreign Application Priority Data

May 27, 2010 (JP) ..... 2010-122133

(51) Int. Cl.
*G03G 15/00* (2006.01)
*G03G 21/20* (2006.01)
*G03G 15/06* (2006.01)

(52) U.S. Cl.
CPC ..... *G03G 21/20* (2013.01); *G03G 15/065* (2013.01); *G03G 15/50* (2013.01); *G03G 21/203* (2013.01)

(58) Field of Classification Search
CPC G03G 15/50; G03G 15/5008; G03G 15/5045
USPC ..... 399/43, 44
See application file for complete search history.

(56) References Cited

U.S. PATENT DOCUMENTS 5,170,210 A 12/1992 Saruwatari
8,229,307 B2 7/2012 Komiya
(Continued)

FOREIGN PATENT DOCUMENTS

JP 63-177177 A 7/1988
JP 8-146752 A 6/1996
(Continued)

OTHER PUBLICATIONS

Japanese Office Action dated May 29, 2012, in related Japanese Patent Application No. 2010-122133 (with English translation).
(Continued)

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes an image bearing member for bearing an image, a developing device for developing with a toner an electrostatic image formed on the image bearing member, and a detecting portion for detecting environmental information. In addition, a storing portion stores the environmental information, and a controller controls an image forming condition on the basis of the environmental information detected in a last detection and current detection. The controller controls the image forming condition so that a change amount per unit time of the image forming condition when the developing device is driven is made larger than a change amount per unit time of the image forming condition when the developing device is stopped.

13 Claims, 11 Drawing Sheets

(56) References Cited

U.S. PATENT DOCUMENTS

| | | | |
|---|---|---|---|
| 2008/0131152 | A1 | 6/2008 | Komiya |
| 2012/0263484 | A1 | 10/2012 | Komiya |

FOREIGN PATENT DOCUMENTS

| | | | |
|---|---|---|---|
| JP | 2808108 | B2 | 10/1998 |
| JP | 2000-029295 | A | 1/2000 |
| JP | 2001-147620 | A | 5/2001 |
| JP | 2004-264756 | A | 9/2004 |
| JP | 2005-140917 | A | 6/2005 |
| JP | 2006-139140 | A | 6/2006 |
| JP | 2006-189562 | A | 7/2006 |
| JP | 2008-139588 | A | 6/2008 |

OTHER PUBLICATIONS

Chinese Office Action dated Aug. 2, 2013, in related Chinese Patent Application No. 201110139304.2 (with English translation).

IMAGE FORMING APPARATUS

This application is a divisional of application Ser. No. 13/106,186, filed on May 12, 2011.

FIELD OF THE INVENTION AND RELATED ART

The present invention relates to an image forming apparatus of an electrophotographic type.

In a conventional image forming apparatus of the electrophotographic type, a toner image is formed by depositing charged toner on an electrostatic latent image formed on an electrostatic photosensitive member and is transferred onto a transfer material to obtain a recording image.

In such an image forming apparatus, an operation of the image forming apparatus has been controlled depending on a relationship between ambient temperature and humidity of the image forming apparatus and a toner charge amount.

For example, Japanese Laid-Open Patent Application No. 2006-139140 describes a control method in which relative humidity in the apparatus is detected by a humidity detecting means and an image forming condition is changed on the basis of a detected value and a control method in which absolute humidity (absolute water content per unit volume) is detected and the image forming condition is changed on the basis of a detected value.

Further, Japanese Patent No. 2808108 discloses that an image forming condition is controlled by storing history of humidity in the neighborhood of a toner hopper or a developing device, obtaining an average of humidity values in a past certain period and by judging that whether or not a predetermined high-humidity state is continued for the certain period to estimate a current moisture absorption state.

As described above, suppression of a fluctuation in image density due to a fluctuation in ambient humidity and temperature of the image forming apparatus has been conventionally attempted. However, in the conventional methods, it has been unable to satisfy required levels with respect to recent stability of density and color in some cases.

That is, according to study of the present inventor, it was found that it is important, for controlling the image forming condition with higher accuracy, that a behavior of humidity control of a developer (a phenomenon that the developer has been adapted from a previously placed ambient state to a currently placed ambient state) is more accurately grasped.

However, in the conventional methods, the develop humidity control behavior during drive and stop of drive of a developing device was not able to be accurately grasped and thus inaccurate control was effected in some cases.

SUMMARY OF THE INVENTION

A principal object of the present invention is to provide an image forming apparatus capable of effecting image forming condition control with higher accuracy by taking into consideration a developer humidity control behavior during drive and stop of drive of a developing device.

According to an aspect of the present invention, there is provided an image forming apparatus comprising:

an image bearing member;

a developing device for developing with toner an electrostatic latent image formed on the image bearing member;

a humidity sensor for providing information on ambient humidity of the image forming apparatus; and a controller for controlling a parameter on a density of an image to be formed on a recording material on the basis of pieces of the information provided by the humidity sensor at different times, wherein said controller is capable of controlling the parameter so that, when a first image forming job is ended at an ending time and then a second image forming job is executed after a lapse of a predetermined time from the ending time and in a period in which a detection result of the humidity sensor changes and then is constant, a difference between a first set value which is the parameter set during formation of a final image in a first image forming job and a second set value which is the parameter set during image formation on a first sheet in the second image forming job after the lapse of the predetermined time from the ending time, increases with an increase of proportion of a time in which the developing device is driven during the lapse of the predetermined time.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, an image forming apparatus according to the present invention will be described more specifically with reference to the drawings.

Embodiment 1

1. General Structure and Operation of Image Forming Apparatus

Figure 1:
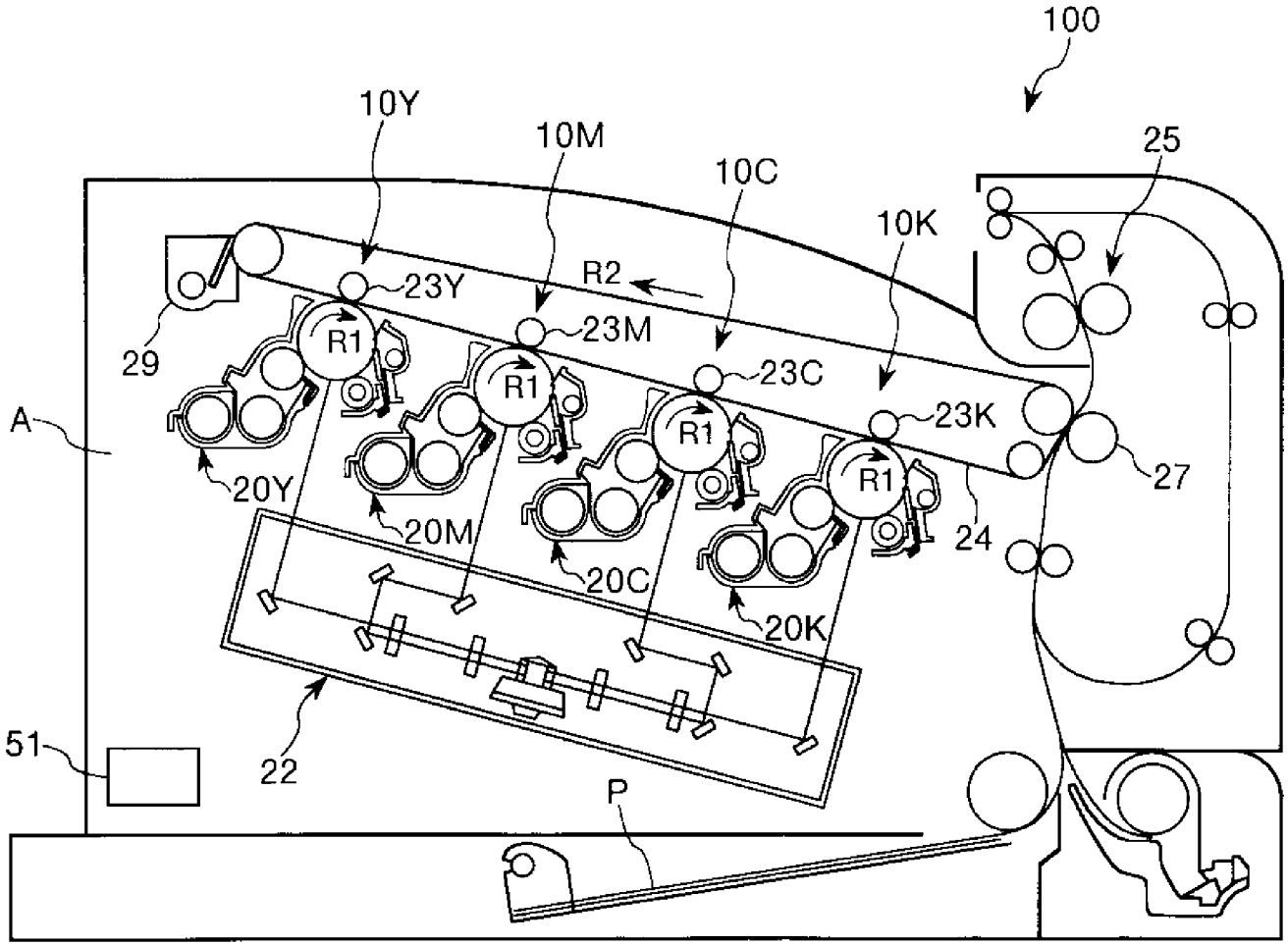
FIG. 1 is a schematic sectional view of an image forming apparatus according to an embodiment of the present invention.

An image forming apparatus according to Embodiment 1 of the present invention will be described. FIG. 1 is a schematic sectional view of an image forming apparatus 100 in this embodiment. The image forming apparatus 100 is a tandem-type laser beam printer capable of forming a full-color image by an electrophotographic image forming process.

The image forming apparatus 100 includes first, second, third and fourth image forming portions 10Y, 10M, 10C and 10K for forming color images of yellow, cyan, magenta and black, respectively. At the respective image forming portions 10Y, 10M, 10C and 10K, drum cartridges 20Y, 20M, 20C and 20K for performing image forming operations of the respective color toner images are disposed. These four drum cartridges 20Y, 20M, 20C and 20K are disposed in parallel along a movement direction of an image transfer surface of an intermediary transfer belt 24. For example, during formation of a full-color image (in a color mode), the toner images formed by the respective drum cartridges 20Y, 20M, 20C and 20K are superposedly transferred onto the intermediary transfer belt 24 which is a toner image receiving member.

Incidentally, in the following description, with respect to elements provided common to the respective image forming portions 10Y, 10M, 10C and 10K, collective explanation will be made in some cases by adding reference numerals or symbols, to the elements, from which suffixes Y, M, C and K are omitted.

Figure 2:
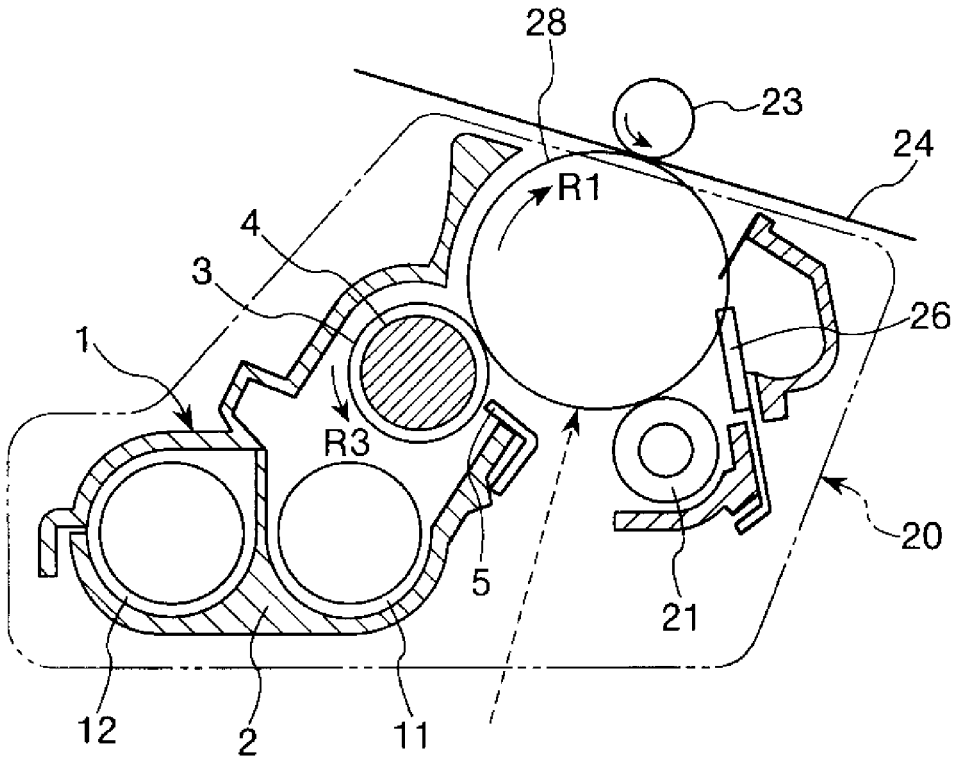
FIG. 2 is a schematic sectional view of a drum cartridge provided in the image forming apparatus according to the embodiment of the present invention.

FIG. 2 is a schematic sectional vie of the drum cartridge 20 of the image forming apparatus 100 in this embodiment. The toner image forming operation in the drum cartridge 20 will be described with reference to also FIG. 2. First, a surface of a drum type (cylindrical) electrophotographic photosensitive member as an image bearing member to be rotationally driven in an arrow R1 direction, i.e., a surface of a photosensitive drum 28 is electrically charged uniformly by a primary charger 21 as a charging means. The charged surface of the photosensitive drum 28 is exposed to laser light emitted from an exposure device (laser scanner) 22 as an exposure means in accordance with image information.

As a result, an electrostatic latent image (electrostatic image) is formed on the photosensitive drum 28. This electrostatic latent image is developed as a toner image by using a developer by a developing device 1 as a developing means. This toner image is transferred (primary-transferred), by a primary transfer roller 23 as a primary transfer means, onto an endless belt-like intermediary transfer belt 24 as an intermediary transfer member to be rotationally driven in an arrow R2 direction. To the primary transfer roller 23, a primary transfer bias which is a DC voltage of an opposite polarity to a normal charge polarity (negative in this embodiment) of the toner is applied from a primary transfer bias voltage source (not shown) as a primary transfer voltage applying means. The toner (primary transfer residual toner) remaining on the photosensitive drum 28 after the toner images are transferred onto the intermediary transfer belt 24 is removed by a photosensitive member cleaner 26 as a photosensitive member cleaning means.

The toner images transferred onto the intermediary transfer belt 24 are collectively transferred (secondary-transferred) onto a transfer material P, such as a recording sheet, which is a toner image receiving member by a secondary transfer roller 27 as a secondary transfer means. To the secondary transfer roller 27, a secondary transfer bias which is a DC voltage of the opposite polarity to the normal charge polarity of the toner is applied from a secondary transfer bias voltage source (not shown) as a secondary transfer voltage applying means. Thereafter, the toner images transferred onto the transfer material P are fixed on the transfer material P by pressing and heating the transfer material P by a fixing device 25 as a fixing means. The transfer material P on which the toner images have been fixed is discharged to the outside of the image forming apparatus 100. Thus, a full-color recording image is obtained. The toner (secondary transfer residual toner) remaining on the intermediary transfer belt 24 after the toner images are transferred onto the transfer material P is removed by a belt cleaner 29 as an intermediary transfer member cleaning means.

Incidentally, during formation of a monochromatic image such as a white-black image (in a monochromatic mode), the toner image is formed only at an associated image forming portion 10 and may only be required to be transferred onto the transfer material P through the intermediary transfer belt 24.

Next, the photosensitive drum 28 will be described. The photosensitive drum 28 in this embodiment is a negatively chargeable OPC (organic photoconductor) photosensitive member and is prepared by providing function layers principally formed of resin materials successively on a drum support, of aluminum, which has been grounded. The surface of the photosensitive drum 28 is uniformly charged by the primary charger 21. A potential at this uniformly charged portion is referred to as a white background portion potential or Vd (V). Then, when this portion is exposed to the laser light by the exposure device 22 on the basis of the image information, the negative electric charge on the surface of the photosensitive drum 28 is cancelled by a positive electric charge transported generated from the above-described function layer, so that the surface potential becomes a potential close to the ground potential. A potential at this portion where the electric charge is attenuated is referred to as an image portion potential or V1 (V).

Next, the primary charger 21 will be described. In this embodiment, the primary charger 21 is a roller-shaped contact charger (charging roller) for charging the surface of the photosensitive drum 28 in contact with the surface of the photosensitive drum 28. At least during the formation of the electrostatic latent image on the photosensitive drum 28, to the primary charger 21, a predetermined charging bias is applied from a primary charging bias voltage source (not shown) as a primary charging voltage applying means. In this embodiment, a negative DC voltage is applied, as the primary charging bias, to the primary charging roller 21.

Next, the developing device 1 will be described. The developing device 1 includes a developing container 2. At an opening of the developing container 2, a developing sleeve 3 as a developer carrying member is disposed. In this embodiment, a two-component developing method is employed as a developing method. As the developer, a two-component developer in which negatively chargeable non-magnetic toner and a magnetic carrier are mixed is used. As the non-magnetic toner, toner which was prepared by kneading and polymerizing a colorant, a wax component and the like in a resin material principally of polyester and then by pulverizing and classifying a resultant product to obtain powder of about 7 μm in volume-average particle size was used. As the magnetic carrier, a carrier which was prepared by coating a silicone resin material on a surface layer of a ferrite core to have the volume-average particle size of 50 μm was used. In this embodiment, a toner content in the developer (a weight ratio of the toner in the developer) in an initial state is 7%.

Further to describe the developing container 2, a part of the developing container 2 which opposes the photosensitive drum 28 is opened and at this opening, the developing sleeve 3 as the developer carrying member is rotatably disposed so as to be partly exposed. The developing sleeve 3 is constituted by a non-magnetic material and contains a stationary magnet 4 as a magnetic field generating means. In this embodiment, the magnet 4 has a plurality of magnetic poles along its outer periphery. Further, during a developing operation, the developing sleeve 3 is rotated in an arrow R3 direction to hold the two-component developer, in a layer, contained in the developing container 2. The developer carried on the developing sleeve 3 forms an erected chain of a magnetic brush in a developing area. This magnetic brush is brought into a contact with or brought near to the surface of the photosensitive drum 28, so that the toner in the two-component developer is supplied to the photosensitive drum 28 depending on the electrostatic latent image formed on the surface of the photosensitive drum 28. As a result, the electrostatic latent image is developed as the toner image. Further, in order to regulate an amount of the developer to be carried on the developing sleeve 3, a blade 5 for regulating a layer thickness of the developer by the action of the magnetic field in a cooperation with the magnet 4 at an upstream side of the developing area with respect to a rotational direction of the developing sleeve 3 is provided. The developer after the electrostatic (latent) image is developed on the photosensitive drum 28 is fed by the rotation of the developing sleeve 3 and is collected in a developing chamber (first developer accommodating chamber), which will be described later, of the developing container 2.

Figure 3:
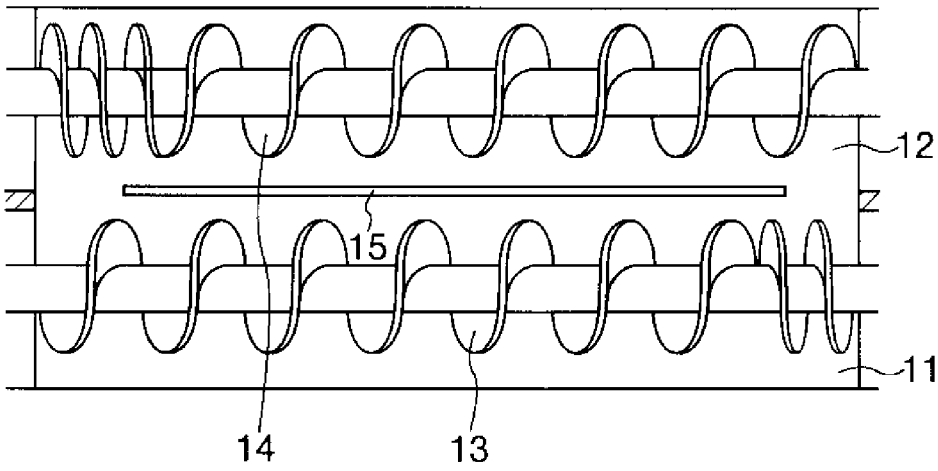
FIG. 3 is a schematic plan view showing an inside of a developing device provided in the image forming apparatus according to the embodiment of the present invention.

Also with reference to FIG. 3, the developing container 2 is roughly divided by a partition wall 15 into two chambers consisting of the developing chamber (first developer accommodating chamber) 11 (at a side close to the developing sleeve 3) and a stirring chamber (second developer accommodating chamber) 12 (at a side remote from the developing sleeve 3). Each of the developing chamber 11 and the stirring chamber 12 is extended along an axial direction of the developing sleeve 3 in this embodiment. The partition wall 15 does not reach each of inner side walls of the developing container 2 at longitudinal end portions of the developing container 2, so that communication portions for permitting passing of the developer between the developing chamber 11 and the stirring chamber 12 are formed. The developing chamber 11 and the stirring chamber 12 are provided with a first screw 13 and a second screw 14, respectively, as a circulating and feeding member (stirring means) for circulating the developer between the developing chamber 11 and the stirring chamber 12. The developing sleeve 3, the first screw 13 and the second screw 14 are configured to be connected and driven by a gear train (not shown) and are rotated by receiving a driving force from a developing device driving gear (not shown). By rotation of these first and second screws 13 and 14, the developer is mixed and stirred while being circulated.

Generally, at least during the developing operation, to the developing sleeve 3, a predetermined developing bias is applied from the developing bias voltage source (not shown) as the developing voltage applying means. Then, by the action of an electric field formed between the photosensitive drum 28 and the developing sleeve 3, the toner is transferred from the developing sleeve 3 onto the photosensitive drum 28. In this embodiment, the developing bias is in the form of a DC component Vdev (V) biased (superposed) with an AC component. An absolute value of a difference between V1 and Vdev is referred to as a contrast potential or Vcont (V). Further, an absolute value of a difference between Vd and Vdev is referred to as a fog (removal) ensuring potential or Vback (V).

In this embodiment, each of the voltage source (power source) for applying the primary charging bias to the primary charger 21 and the voltage source (power source) for applying the developing bias to the developing sleeve 3 is provided as two power sources for the first, second and third image forming portions 10Y, 10M and 10C and for the fourth image forming portion 10K. As a result, during output of the white-black (monochromatic) image, there are no needs to apply the biases to the primary chargers 21 and the developing sleeves 3 at the first, second and third developing sleeves 3.

Figure 4:
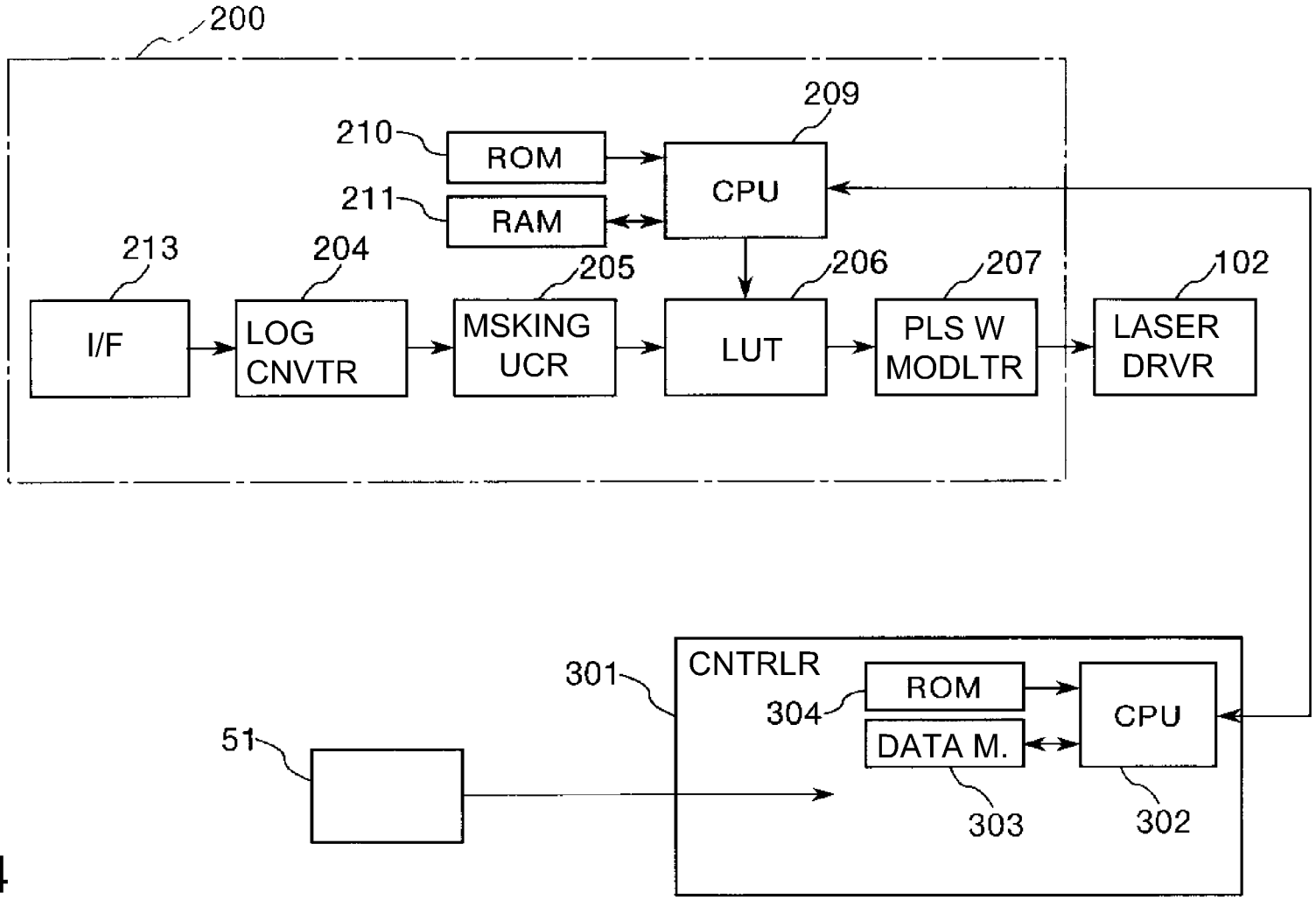
FIG. 4 is a schematic control block diagram of the image forming apparatus according to the embodiment of the present invention.

Next, the exposure by the exposure device 22 will be described. FIG. 4 is a block diagram showing a system constitution of the image forming apparatus 100 in this embodiment. Referring to FIG. 4, an image forming unit 200 inputs color image data as RGB image data, as desired, from an external device (not shown) such as an original scanner or a computer (information processing apparatus) through an external input interface (I/F) 213. A LOG converter 204 converts luminance (brightness) data of the inputted RGB image data into density data of respective colors of yellow (Y), magenta (M) and cyan (C) (YMC image data) on the basis of a look-up table (LUT) constituted by data stored in ROM 210. A masking/VCR portion 205 extracts component data for black (K) and subjects YMCK image data to matrix operation in order to correct color tubidity of colorants for recording. A look-up table portion (LUT portion) 206 subjects the inputted YMCK image data to density correction every color by using γ look-up table so as to match an ideal gradation characteristic of the image forming apparatus 100. Incidentally, the γ look-up table is prepared on the basis of data developed on RAM 211 and contents thereof are set by a CPU 209. A pulse width modulating portion 207 outputs a pulse signal with a pulse width corresponding to a level of the image data (image signal) inputted from the LUT portion 206. On the basis of this pulse signal, a laser driver 102 drives the exposure device 22 to irradiate the surface of the photosensitive drum 28 with laser light, so that the electrostatic latent image is formed on the photosensitive drum 28.

In this embodiment, an operation of an apparatus main assembly A of the image forming apparatus 100 is collectively effected by a main assembly controller 301, inclusive of image forming condition control which will be described later. The main assembly controller 301 operates with a CPU 302, as a basic portion, which is provided therein. The CPU 302 controls respective portions of the apparatus by effecting computing (processing) in accordance with a program and data stored in ROM 304 and a data memory holding means (data memory) 303. Further, the CPU 302 of the main assembly controller 301 cooperates with the CPU 209 on the image forming unit side through an interface. In this embodiment, the data memory 303 is, as described later, a storing means for storing environmental information and time information relating to the environmental information based on a measurement result of a temperature/humidity sensor 51. Further, in this embodiment, the CPU 302 functions, as described later, as a control means for controlling the image forming condition on the basis of a plurality of pieces of environmental information and pieces of time information relating to the pieces of the environmental information which are based on the measurement result of the temperature/humidity sensor 51 and on the basis of information relating to a driving state of the developing device 1.

In the image forming apparatus 100, the temperature/humidity sensor 51 for measuring ambient temperature and humidity of the image forming apparatus 100 is provided as an environment detecting means (environment sensor). Further, as will be specifically described later, the image forming condition is determined by effecting processing by the CPU 302 on the basis of a detection result or the like of the temperature/humidity sensor 51.

2. Image Forming Condition Control

Next, the image forming condition control will be described. Hereinafter, the description will be made by focusing attention on the image forming condition regarding one image forming portion 10.

2-1. Result of Study

As described above, in the conventional methods, the recent required level relating to the stability of the density and color was not able to be satisfied in some cases. Therefore, the present inventor conducted the following experiment. That is, a plurality of small-sized temperature/humidity sensors ("SHT 15", mfd. by Sensiron AG, Switzerland) were disposed at portions in a developing container of a drum cartridge of a laser beam printer ("LBP 5900", mfd. by Canon K.K.) so as to be contacted to or buried in the developer. Then, a behavior of a change in humidity measured by the temperature/humidity sensors was checked in detail. As a result, with respect to the humidity control of the developer (the phenomenon that the developer has been adapted from the previously placed ambient state to the currently placed ambient state), the following were focused. Incidentally, to the laser beam printer (LBP 5900), the present invention is not applied but basic mechanical and electrical constitutions of the laser beam printer are identical to those of the image forming apparatus in this embodiment.

Study Result 1:

A humidity control speed of the developer largely varies depending on a position of the developer. Specifically, the developer coated with a thin layer on the developing sleeve is quickly (in units of several tens of seconds) humidity-controlled. Further, a surface layer of the developer in the developing container is also relatively quickly (in units of several minutes) humidity-controlled. An area, of the developer in the developing container, confined inside the developer is slowly humidity-controlled in several tens of minutes to several hours.

Incidentally, herein the "humidity control speed" is expressed by a time constant when a change curve of the measured humidity of the developer is approximated by an exponential function.

In accordance with the humidity control speed characteristics described above, the humidity of the developer in the developing container exhibits the following behavior. That is, when the developing device is not driven, the developer on the developing sleeve and the surface layer of the developer in the developing container are humidity-controlled but the inside of the developer in the developing container is not readily humidity-controlled. When drive of the developing device is started, the developer is successively humidity-controlled quickly by passing through the surface of the developer on the developing sleeve and in the developing container.

When this phenomenon is grasped as the humidity speed of the developer, in the case of LBP 5900 used in this experiment, the time constants of the humidity control when the developing device was driven and when the drive of the developing device was stepped were 5 minutes and 240 minutes, respectively.

That is, in the conventional methods, such a developer humidity control behavior during the drive and stop of the drive of the developing device was not able to be grasped accurately and therefore the inaccurate humidity control was effected in some cases. Further, for that reason, the stability of the density and color was unable to meet the high required level in recent years in some cases.

Therefore, one of the objects in this embodiment is to effect the control with high accuracy by accurately grasping the developer humidity control behavior during the drive and stop of the drive of the developing device. Further, as a result, satisfaction of the high required level regulating the stability of the density and color in recent years is also one of the objects in this embodiment.

2-2. Reference Example

The most simple conventional control method of the image forming condition is a method in which at least one of Vcont, Vback and γ look-up table is controlled correspondingly to an output of the temperature/humidity sensor. However, in this method, a time until a function member such as the developer is adapted to the ambient humidity of the image forming apparatus is not taken into consideration. For this reason, as described in Japanese Patent No. 2808108, the method in which the current image forming condition is controlled by using environmental history information.

Figure 11:
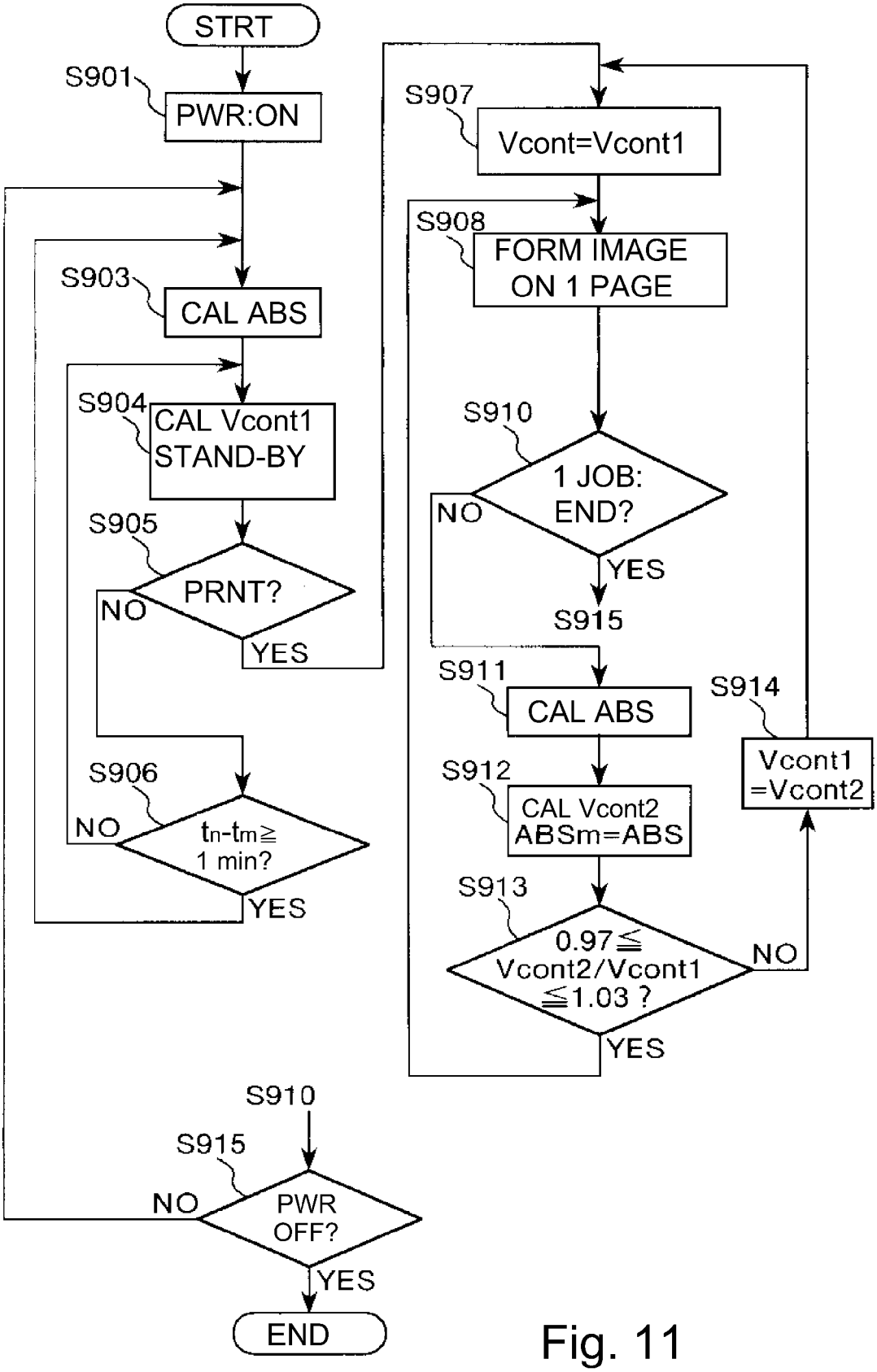
FIG. 11 is a flow chart of image forming condition control in the reference example.

Here, first, in order to facilitate the understanding of a specific example, as will be described later, in accordance with the present invention, a reference example in which the current image forming condition is controlled by using the environmental history information will be described. The present invention is not applied but basic mechanical and electrical constitutions of an image forming apparatus in the reference example are identical to those in this embodiment. FIG. 11 is a flow chart of control in this reference example.

First, a power source of an apparatus main assembly A is turned on (S901). Then, an absolute water content value ABS ($g/m^3$) used for determining a value of Vcont1 described later is calculated (S903).

The value ABS is obtained by calculation from the following data in the main assembly controller 301. First, there are absolute water content data ABSm which have been stored immediately before the calculation, and time data tm (year, month, day and hour, minute, second) when the data ABSm is obtained. In addition, there are current absolute water content data ABSn which are obtained from values of current temperature (° C.) and relative humidity (%) which were measured by the temperature/humidity sensor 51, and current time data tn (year, month, day and hour, minute, second). These data are updated and stored in the data memory 303 of the main assembly controller 301. In the main assembly controller 301, a battery is mounted and therefore can drive a time measuring means and a data memory holding means even when the power source of the apparatus main assembly A is not turned on.

The value ABS may be obtained by collinear approximation in accordance with a predetermined slope obtained from two absolute water content data different in time or may also be obtained by approximately the behavior between the two absolute water content data different in time by using exponential function. In this embodiment, the value ABS is obtained by the approximation by using the exponential function. An exponential function approximation expression (correlating equation) in this reference example is as follows.

$$ABS(g/m^3)=(ABSm-ABSn)\times\exp(-(tn-tm)/\alpha)+ABSn \quad (1)$$

Here, a difference between tn and tm is calculated in units of 0.01 minute, and α which is a time constant of the exponential function is 240 minutes.

The thus obtained value ABS is regarded as the absolute water content of the inside ambience of the image forming apparatus 100, estimated from progression of ambient temperature and humidity at the periphery of the image forming apparatus, i.e., an absolute water content (predicted temperature and humidity information) of air contained in the developer in the developing container 2.

From this value ABS, the latest set value Vcont1 of Vcont which is one of the image forming conditions is calculated by making reference to a predetermined Vcont look-up table and is stored in the data memory 303 of the main assembly controller 301, so that the image forming apparatus 100 is placed in a print stand-by state (S904). Further, at the same time, the absolute water content data ABSm is updated to a newly calculated value ABS and is stored. A relationship between ABS and Vcont was obtained in advance by an experiment and has been stored, as a look-up table, in the ROM 304 of the main assembly controller 301.

Incidentally, the reason why the history of the AWC is used as the environmental history information in this embodiment is that the toner charge amount of the two-component developer used in this embodiment is highly correlated with the absolute water content compared with the relative humidity.

Next, whether or not a print instruction is provided is judged (S905). In the case where there is no print instruction in S905, a value of tn−tm is calculated and is judged as to whether or not the value is not less than 1 minute (S906). In the case where the value of tn−tm is not less than 1 minute in S906, the procedure is returned to S903 in which the value ABS is calculated again. On the other hand, in the case where the value of tn−tm is less than 1 minute in S906, the value ABS is not calculated again and the procedure is returned to S904 in which the image forming apparatus is placed in a print stand-by state.

In the case where judgment that the print instruction is provided is made in S905, values of high-voltage biases to be applied to the primary charger 21 and the developing sleeve 3 are set so that the value of Vcont equals to the value of Vcont1 (S907). Then, at this setting, image formation for one page is effected (S908). Generally, the print instruction is provided in a "job" unit such that "print a specific image on a predetermined number of sheets in a particular order". In this reference example, first whether or not the image formation for one page is completed is judged and then whether or not the job is ended is judged (S910). In the case where the job is not ended is judged in S910, the value ABS is calculated again (S911).

Next, from the same look-up table as that from which Vcont1 is called up in S904, a value of Vcont2 corresponding to the newly calculated value ABS is calculated (S912). Further, at the same time, the absolute water content data ABSm stored in the data memory 303 of the main assembly controller 301 is updated to the newly calculated value ABS and then is stored.

Next, whether or not a value of Vcont2/Vcont1 satisfies a condition of not less than 0.97 and not more than 1.03 is judged (S913). In the case where the condition is judged as being satisfied in S913, i.e., in the case where an amount of fluctuation of Vcont2 which is the newly calculated Vcont is within ±3% of Vcont1 which is Vcont up to now, the value of Vcont is kept at Vcont1 and the procedure is returned to S908 in which subsequent image formation is effected. On the other hand, in the case where the condition is judged as being not satisfied in S913, i.e., in the case where the fluctuation amount of Vcont2 exceeds ±3% of Vcont1 (which is Vcont up to now), the value of Vcont1 is replaced with the newly calculated value Vcont2 (S914). Then, the procedure is returned to S907 in which the high-voltage bias values are set again so that the value of Vcont equals to the newly replaced value of Vcont1.

Operations in the above-described steps S907, S908 and S910 to S914 are repeated until one job is ended. Further, in the case where the job is judged as being ended in S910, and then whether or not the power source of the apparatus main assembly A is turned off is judged (S915). Thereafter, the procedure is returned to S903 unless the power source is judged as being turned off in S915, and subsequent processing is repeated.

Thus, in this reference example, from the values of the absolute water contents ABSm and ABSn at the times tm and tn, respectively, i.e., from history information of the absolute water contents, on the basis of the exponential function with the time constant of 240 minutes, the absolute water content at the inside of the image forming apparatus 100 is estimated. This estimated absolute water content at the inside of the image forming apparatus 100 is regarded as the absolute water content of air contained in the developer at the inside of the developing container 2. Then, from this estimated absolute water content, a current developing characteristic of the developer is determined. In this reference example, on the basis of such a premise, the value of Vcont as the image forming condition is determined.

2-3. Specific Example

Next, a specific example in accordance with the present invention will be described. In this specific example, two values of a speed (time constant) at which the functional member such as the developer in the developing device 1 is adapted to the ambient humidity of the image forming apparatus are set correspondingly to the presence (drive) and absence (stop of drive) of drive of the developing device 1, and proper time constants α are used in a switching manner. This point is different from the reference example described above.

Figure 5:
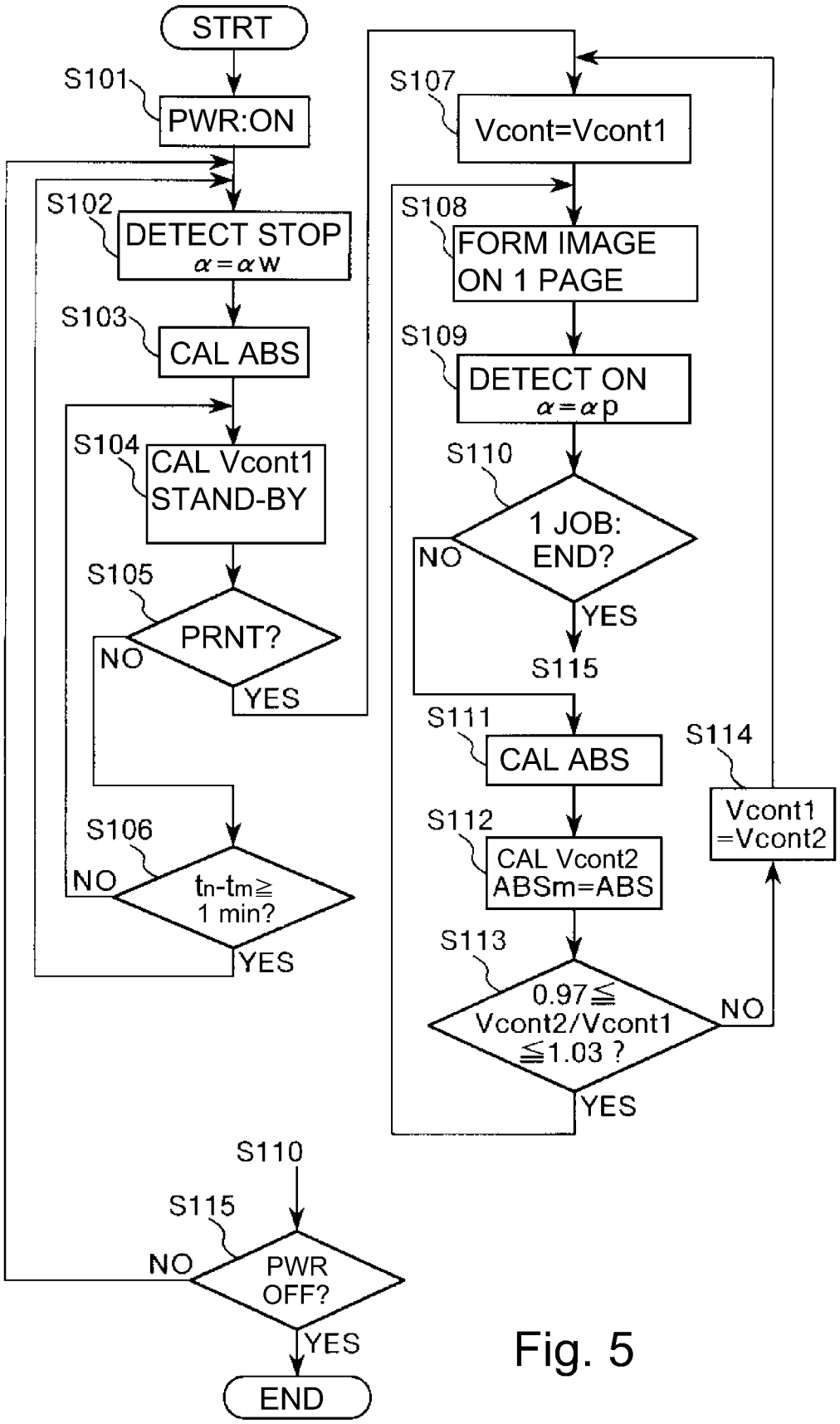
FIG. 5 is a flow chart of an example of image forming condition control in accordance with the present invention.

FIG. 5 is a flow chart of control in this specific example.

First, a power source of an apparatus main assembly A is turned on (S101). Next, stop of drive of the developing device 1 is detected, and the time constant α is set at αw=240 minutes (S102).

Incidentally, the stop of drive of the developing device 1 or the drive of the developing device 1 as described later can be detected by checking an operation state of a driving means for transmitting a driving force to the developing device 1. For example, the operation state such as an ON/OFF state of a driving motor or an ON/OFF state of a driving connection device (clutch) may be checked.

Then, an absolute water content value ABS ($g/m^3$) used for determining a value of Vcont 1 described later is calculated (S103). The value ABS is obtained in the same manner as in the reference example described above but this specific example is different from the reference example in that α=αw is set.

That is, the value ABS is obtained by calculation from the following data in the main assembly controller 301. First, there are absolute water content data ABSm which have been stored immediately before the calculation, and time data tm (year, month, day and hour, minute, second) when the data ABSm is obtained. In addition, there are current absolute water content data ABSn which are obtained from values of current temperature (° C.) and relative humidity (%) which were measured by the temperature/humidity sensor 51, and current time data tn (year, month, day and hour, minute, second). These data are updated and stored in the data memory 303 of the main assembly controller 301. In the main assembly controller 301, a battery is mounted and therefore can drive a time measuring means and a data memory holding means even when the power source of the apparatus main assembly A is not turned on.

Similarly as the reference example described above, in this specific example, the value ABS is obtained by approximately the behavior between the two absolute water content data different in time by using exponential function. An exponential function approximation expression used in S103 in this specific example is as follows.

$$ABS(\mathrm{g/m^3})=(ABSm-ABSn)\times\exp(-(tn-tm)/\alpha w)+ABSn \quad (2)$$

Here, a difference between tn and tm is calculated in units of 0.01 minute, and αw which is a time constant of the exponential function is 240 minutes.

From this value ABS, the latest set value Vcont 1 of Vcont which is one of the image forming conditions is calculated by making reference to a predetermined Vcont look-up table and is stored in the data memory 303 of the main assembly controller 301, so that the image forming apparatus 100 is placed in a print stand-by state (S104). Further, at the same time, the absolute water content data ABSm is updated to a newly calculated value ABS and is stored. A relationship between ABS and Vcont was obtained in advance by an experiment and has been stored, as a look-up table, in the ROM 304 of the main assembly controller 301.

Next, whether or not a print instruction is provided is judged (S105). In the case where there is no print instruction in S105, a value of tn−tm is calculated and is judged as to whether or not the value is not less than 1 minute (S106). In the case where the value of tn−tm is not less than 1 minute in S106, the procedure is returned to S103 in which the value ABS is calculated again. On the other hand, in the case where the value of tn−tm is less than 1 minute in S106, the value ABS is not calculated again and the procedure is returned to S104 in which the image forming apparatus is placed in a print stand-by state.

In the case where judgment that the print instruction is provided is made in S105, values of high-voltage biases to be applied to the primary charger 21 and the developing sleeve 3 are set so that the value of Vcont equals to the value of Vcont 1 (S107). Then, at this setting, image formation for one page is effected (S108). Next, different from the above-described reference example, in this specific example, the drive of the developing device 1 is detected and the time constant α is set at αp=5 minutes (S109). Then, first whether or not the image formation for one page is completed is judged and then whether or not the job is ended is judged (S110). In the case where the job is not ended is judged in S110, the value ABS is calculated again (S111).

An exponential function approximation expression used in S110 in this specific example is as follows.

$$ABS(\mathrm{g/m^3})=(ABSm-ABSn)\times\exp(-(tn-tm)/\alpha p)+ABSn \quad (3)$$

Here, a difference between tn and tm is calculated in units of 0.01 minute, and αp which is a time constant of the exponential function is 5 minutes.

Thus, in this specific example, the time constant α is set at two levels including αp=5 minutes and αw=240 minutes. This is a reflection, in the image forming condition control, of new findings of the present inventor such that the time constants of the humidity control when the developing device was driven and when the drive of the developing device was stopped were 5 minutes and 240 minutes, respectively, in the above-described study using the printer (LBP 5900).

In subsequent steps, the substantially same processing as in the above-described reference example is effected.

That is, next, from the same look-up table as that from which Vcont1 is called up in S104, a value of Vcont2 corresponding to the newly calculated value ABS is calculated (S112). Further, at the same time, the absolute water content data ABSm stored in the data memory 303 of the main assembly controller 301 is updated to the newly calculated value ABS and then is stored.

Next, whether or not a value of Vcont2/Vcont1 satisfies a condition of not less than 0.97 and not more than 1.03 is judged (S113). In the case where the condition is judged as being satisfied in S113, i.e., in the case where an amount of fluctuation of Vcont2 which is the newly calculated Vcont is within ±3% of Vcont1 which is Vcont up to now, the value of Vcont is kept at Vcont1 and the procedure is returned to S108 in which subsequent image formation is effected. On the other hand, in the case where the condition is judged as being not satisfied in S113, i.e., in the case where the fluctuation amount of Vcont2 exceeds ±3% of Vcont1 (which is Vcont up to now), the value of Vcont1 is replaced with the newly calculated value Vcont2 (S114). Then, the procedure is returned to S107 in which the high-voltage bias values are set again so that the value of Vcont equals to the newly replaced value of Vcont1.

In this specific example, compared with the above-described reference example, the manner of obtaining the value ABS for obtaining Vcont2 is different and therefore in the case where the image forming apparatus, the value of Vcont2 used for the judgment in S113 and used as Vcont is different from that in the above-described reference example.

Operations in the above-described steps S107 to S114 are repeated until one job is ended. Further, in the case where the job is judged as being ended in S110, and then whether or not the power source of the apparatus main assembly A is turned off is judged (S115). Thereafter, the procedure is returned to S102 unless the power source is judged as being turned off in S115. Then, the step of the drive of the developing device 1 is detected and the time constant α is set again at αw=240 minutes and subsequent processing is repeated.

Thus, in some cases, the temperature/humidity environment measured by the temperature/humidity sensor 51 is changed to that different from the temperature/humidity environment indicated by the environmental information (ABSm) at a first time stored in the data memory 303. Further, in this embodiment, the CPU 302 which is the control means controls the image forming condition as described below when the image forming condition is changed to that different from the image forming condition corresponding to the temperature/humidity environment indicated by the environmental information at the first time after the temperature/humidity environment is changed as described above. That is, the image forming condition is changed to different image forming conditions between the case where the developing device 1 is driven before the change of the image forming condition and the case where the developing device 1 is not driven before the change of the image forming condition. Incidentally, the drive of the developing device 1 includes at least one of an operation for feeding the developer inside the developing device 1 and an operation for stirring the developer inside the developing device 1 but in this embodiment, both of the operations are performed.

Particularly, in this embodiment, the CPU 302 calculates the estimated temperature/humidity environment, to be reflected in the image forming condition control, at the inside of the image forming apparatus 100 by using the predetermined correlating equation obtained from the plurality of pieces of the environmental information on the basis of the measurement result of the temperature/humidity sensor 51 and from the time information (environmental history information) relating to the respective pieces of the environmental information. That is, the environmental information at the first time (ABSm) and the time information relating to the environmental information (ABSm), and the environmental information at the second time (ABSn) and the time information relating to the environmental information (ABSn) are applied to the predetermined correlating equation. Then, the estimated temperature/humidity (ABS) different from the temperature/humidity environment indicated by the environmental information at the second time is calculated. The CPU 302 set the image forming condition at the second time as the image forming condition corresponding to this estimated temperature/humidity environment. Then, the CPU 302 changes the image forming condition after the change of the image forming condition by providing different predetermined correlating equations between the case where the developing device 1 is driven before the change of the image forming condition and the case where the developing device 1 is not driven before the change of the image forming condition.

Thus, the CPU 302 controls the image forming condition, on the basis of the different exponential function approximation expressions in the case where the environment is changed, so as to be stepwisely changed to the image forming condition corresponding to the environment after the change of the image forming condition (the environmental information at the second time (ABSn)). Then, the CPU 302 is provided with the different exponential function approximation expressions corresponding to the case where the developing device is driven and the case where the developing device is not driven. As a result, it is possible to control the image forming condition so that a reaching time in which the image forming condition before the change in environment reaches the image forming condition corresponding to the environment after the change is shorter with a longer time of the drive of the developing device after the change in environment. Accordingly, the behavior of the humidity control of the developer (the phenomenon that the developer is adapted from the previously placed ambient state to the currently placed ambient state) can be controlled correspondingly to the developer humidity control behavior during the drive and stop of the drive of the developing device.

As described above, the image forming condition control was explained by focusing the attention on that regarding one image forming portion 10. Here, an example of an application manner of the image forming condition control regarding the respective image forming portions 10 will be described. In the image forming apparatus in this embodiment, the primary charging bias voltage sources and developing bias voltage sources for the first, second and third image forming portions 10Y, 10M and 10C are collectively controlled, and the primary charging bias voltage source and developing bias voltage source for the fourth image forming portion 10K are collectively controlled. Incidentally, in the case of the white/black (monochromatic) mode, the image forming condition control as shown in FIG. 5 may be effected only for the fourth image forming portion 10K and there is no need to effect the image forming condition control as shown in FIG. 5 for the first to third image forming portions 10Y, 10M and 10C.

2-4. Comparison

Next, with reference to FIGS. 6 and 7, the difference between the reference example and the specific example will be described more specifically. For purposes of illustration, a value of ABS(0) which has been changed and stored before the last turning-on of the power source of the apparatus main assembly A is taken as 20 (g/m$^3$) and a time at which the value of ABS(0) was calculated is taken as t(0)=0 (minute). Further, a time of subsequent turning-on of the power source of the apparatus main assembly A is t(1)=120 minutes and at that time, the temperature and humidity which are detected by the temperature/humidity sensor are 23° C. and 57%, i.e., the absolute water content is 10 (g/m$^3$). Further, in the environment of constant temperature and humidity of 23° C. and 57%, an operation such that an A4-sized image was outputted on 30 sheets (for 1 minute in LBP5900) and then the output was paused for 10 minutes was repeated by the image forming apparatus 100.

Figure 6:
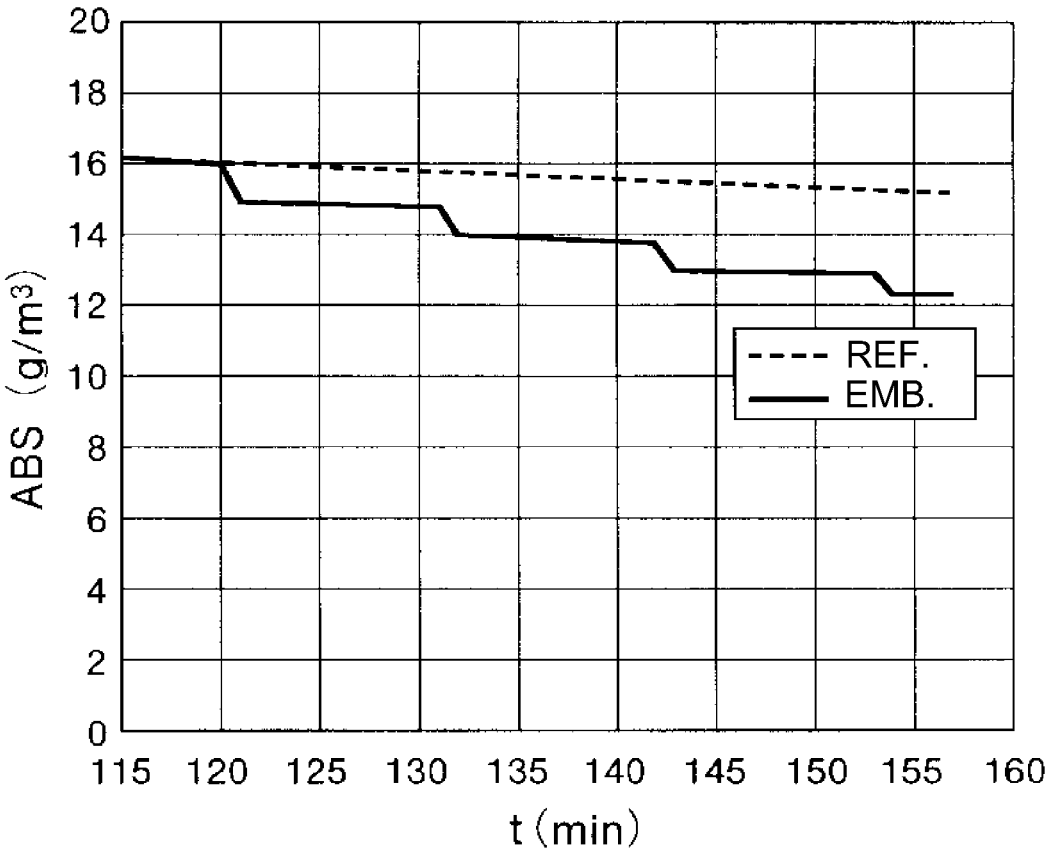
FIG. 6 is a graph showing a change in ABS value in a reference example and a specific example in accordance with the present invention.

FIG. 6 shows progression with time of the calculated value ABS. The progression of the value ABS in the reference example only shows a monotonical change (with a constant small slope in the graph). On the other hand, it is understood that the progression of the value ABS in the specific example is largely changed in change rate per unit time (with an increasing slope in the graph) during the drive of the developing device 1 in the image forming operation.

Figure 7:
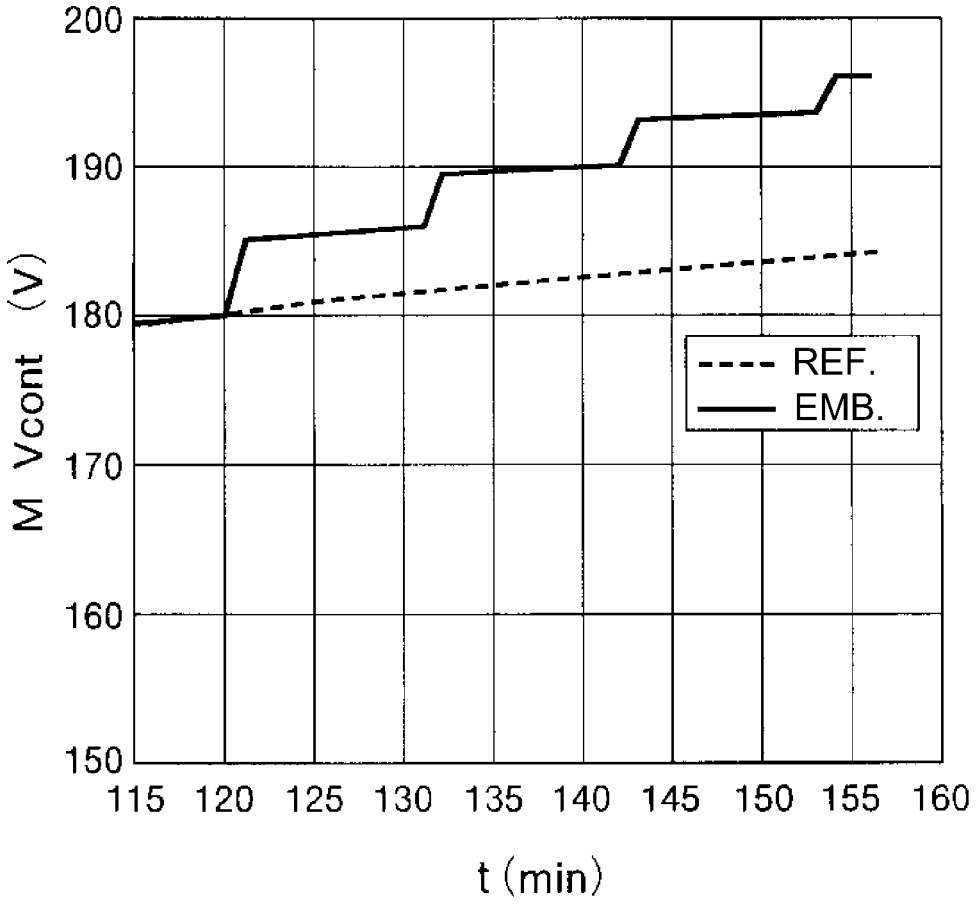
FIG. 7 is a graph showing a change in Vcont value in the reference example and the specific example in accordance with the present invention.

FIG. 7 shows progression with time of the value Vcont set as the image forming condition. In the specific example, the value Vcont is changed so that the toner amount of the toner image, i.e., the image density is kept constant correspondingly to the progress of the humidity control of the developer in the developing device 1 by the drive of the developing device 1. That is, the progression of the value Vcont in the specific example is such that the change rate per unit time is largely changed (the slope in the graph is increased) during the drive of the developing device 1 in the image forming operation. On the other hand, in the reference example, the change in Vcont does not catch up with the humidity control speed of the developer and therefore the image density is gradually lowered. That is, the progression of the value Vcont in the reference example shows only a monotonical change (with a constant small slope in the graph). Here, e.g., in the image forming condition control in the reference example, the assumption that the time constant is adjusted so that the change in Vcont approaches that in the image forming condition control in the specific example is made. Even when such an adjustment is made, it would be considered that the adjustment is suitable only in the case where the image forming operation such that "the A4-sized image was outputted on 30 sheets (for 1 minute in LBP5900) and then the output was paused for 10 minutes" is repeated and therefore, this lacks versatility and thus is not practical.

In this embodiment, in the case where the image forming condition is changed after the temperature environment is changed from the environment indicated by the environmental information at the first time, the condition after the change is closer to the condition corresponding to the temperature/humidity environment at the first time when the developing device 1 is not driven before the change than when the developing device 1 is driven before the change. That is, in the graph in FIG. 7, the value Vcont is closer to the value Vcont corresponding to the environment at the first time during start of the control in a period after the slope is increased by the drive of the developing device 1 than in a period before the slope is increased from that during the start of the control in which the developing device 1 is not driven. Further, in the case where the change in image forming condition is successively made plural times after the above-described change in environment, the change rate of the image forming condition is larger in the case where the developing device is not driven before the changes of the respective image forming conditions are made than in the case where the developing device is driven before the changes of the respective image forming conditions are made. That is, in the graph of FIG. 7, the change rate of the value Vcont is larger, in the period in which the developing device 1 is driven before the changes of the respective values Vcont and the slope is increased, than in the period in which the developing device 1 is not driven before the changes of the respective values Vcont and the slope is small.

As described above, according to this embodiment, it is possible to effect the control with high accuracy by accurately grasping the developer humidity control behavior during the drive and stop of the drive of the developing device. As a result, it is possible to meet the high required level in recent years with respect to the stability of density and color.

Embodiment 2

Next, another embodiment according to the present invention will be described. Basic constitution and operation of an image forming apparatus in this embodiment are identical to those in Embodiment 1. Accordingly, elements having functions and constitutions identical or corresponding to those in Embodiment 1 are represented by the same reference numerals or symbols and will be omitted from detailed explanation. In the following, a point different from Embodiment 1 will be principally described.

First, in this embodiment, a polymerization toner produced by using a suspension polymerization was used as the toner. The polymerization toner has a volume-average particle size of 6 μm. Further, as the magnetic carrier, a magnetic resin carrier prepared by dispersing and polymerizing magnetic powder such as magnetite powder in a phenolic resin to form particles and by surface-coating the particles with an acrylic resin was used. The magnetic carrier has the volume-average particle size of 35 μm. These toner and carrier were mixed to provide a toner content of 7% and were used.

The toner charge amount of the two-component developer used in this embodiment has higher correlativity with the relative humidity than the absolute water content. This is presumably because the materials different from those in Embodiment 1 are used for the two-component developer. It would be considered that whether or not such a toner charge amount depends on what humidity index (the absolute water content, the relative humidity or an assumed intermediate index between the absolute water content and the relative humidity) varies depending on charge control agents to be added to the resin for the toner, and the resin for the carrier and on an external additive for the toner, and the like. Accordingly, in general, there is a need to check, through an experiment, whether or not the toner charge amount depends on what humidity index. In this embodiment, on the basis of the result of the experiment conducted in advance, a history of the relative humidity was used as the environmental history information in the image forming condition control.

Further, in this embodiment, the image forming apparatus 100 independently includes the bias voltage sources (not shown) for generating the primary charging bias and the developing bias with respect to the first, second, third and fourth image forming portions 10Y, 10M, 10C and 10K. In the following, the description will be made by focusing attention on the image forming condition control with respect to one image forming portion 10.

Further, in this embodiment, as the image forming condition control, density correction using γ look-up tables (γ LUTs) is made in addition to the control of the value Vcont. In this embodiment, the relative humidity (values of RH which will be described later) is divided into eight (first to eighth) environmental sections and with respect to each of the first to eighth environmental sections, the value Vcont is set. A relationship between each environmental section and the value Vcont is stored in advance in the ROM 304 of the main assembly controller 301. Further, each of the divided 8 sections is further divided into 5 sub-sections. Thus, 5 (first to fifth) γ look-up tables each determined from the value Vcont and the relative humidity, i.e., 40 γ look-up tables for each of the 8 sections (160 γ look-up tables in total for the four colors) are stored in the ROM 210. These γ look-up tables are developed on the RAM 211 in accordance with an instruction from the CPU 201 and then are used. Here, the γ look-up table refers to a table, for determining 256 output levels with respect to 256 input levels, in which description that an output product of the image forming apparatus can obtain a desired density gradation level when laser light exposure with what pulse width is effected with respect to an inputted image signal has been made.

Figure 8:
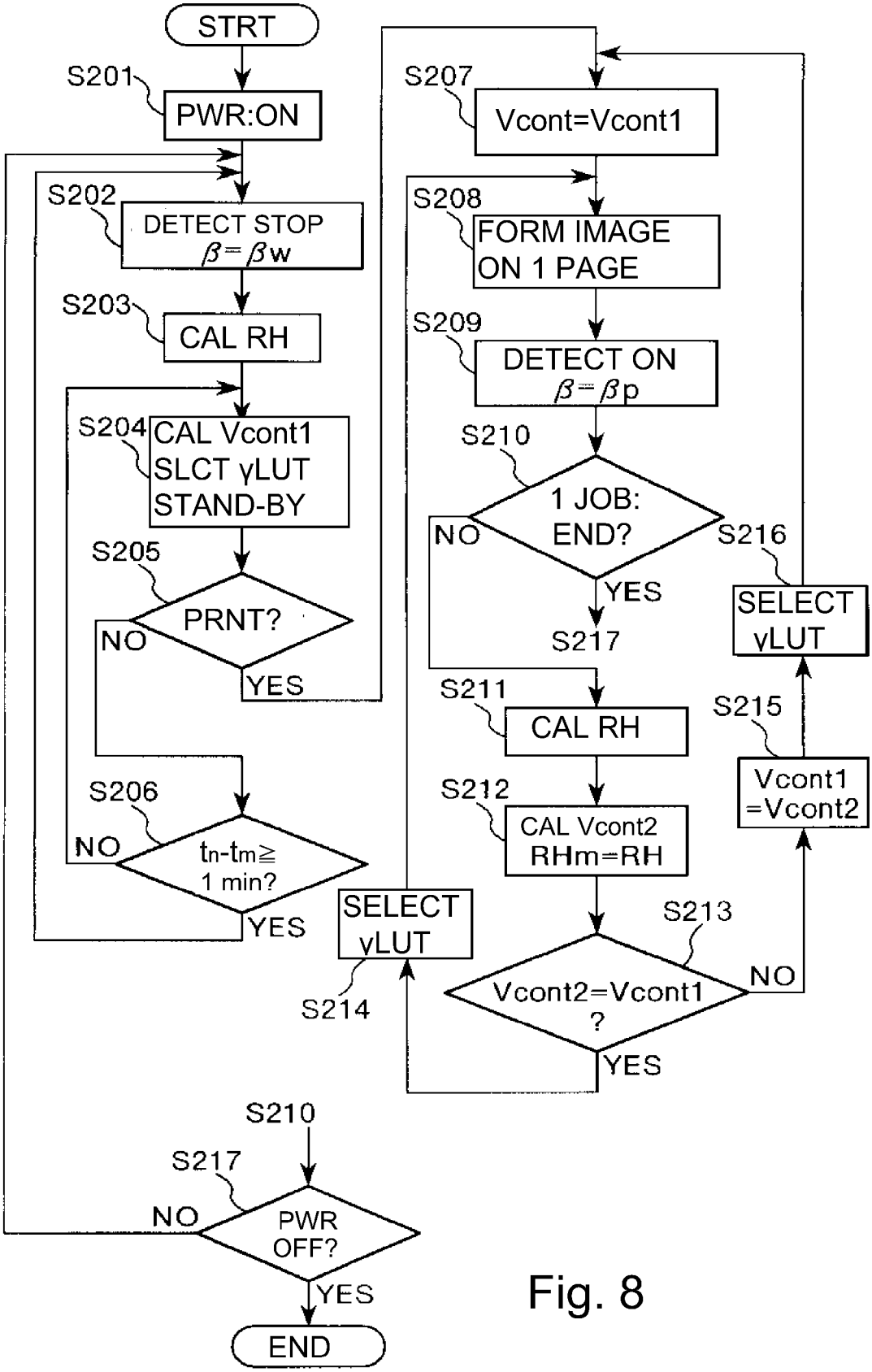
FIG. 8 is a flow chart of another example of the image forming condition control in accordance with the present invention.

FIG. 8 is a flow chart of control in this embodiment.

First, a power source of an apparatus main assembly A is turned on (S201). Next, stop of drive of the developing device 1 is detected, and a time constant described later is set at βw=240 minutes (S102). Then, relative humidity value RH (%) used for determining a value of Vcont 1 described later is calculated (S203). The relative humidity is obtained as a ratio of current water vapor pressure to saturated water vapor pressure at a temperature and a humidity at measurement time. Incidentally, it may be considered that the pressure in an ambience in which the image forming apparatus 100 in this embodiment is used is substantially constant.

The value RH is obtained by calculation, through exponential function approximation, from the following data in the main assembly controller 301. First, there are relative humidity data RHm which have been stored immediately before the calculation, and time data tm (year, month, day and hour, minute, second) when the data RHm is obtained. In addition, there are current relative humidity data RHn measured by the temperature/humidity sensor 51, and current time data tn (year, month, day and hour, minute, second). These data are updated and stored in the data memory 303 of the main assembly controller 301. In the main assembly controller 301, a battery is mounted and therefore can drive a time measuring means and a data memory holding means even when the power source of the apparatus main assembly A is not turned on.

Similarly as the reference example described above, in this specific example, the value ABS is obtained by approximately the behavior between the two absolute water content data different in time by using exponential function. An exponential function approximation expression in this embodiment is as follows.

$$RH(\%)=(RHm-RHn)\times\exp(-(tn-tm)/\beta w)+RHn \quad (4)$$

Here, a difference between tn and tm is calculated in units of 0.01 minute, and βw which is a time constant of the exponential function is 240 minutes.

Next, in S204, the CPU 302 selects a value Vcont1 in the environmental section depending on the value RH. Further, via the CPU 302, the CPU 209 selects the γ look-up table, from the 5 look-up tables in the associated environmental section, depending on the value RH and develops data of the selected γ look-up table on the RAM 211, so that the image forming apparatus 100 is placed in a print stand-by state (S204). Further, at the same time, the relative humidity data RHm is updated to a newly calculated value RH and is stored.

As a result, even when the value Vcont is roughly changed, tone gradation of the output image is kept by finely changing the γ look-up table.

Next, whether or not a print instruction is provided is judged (S205). In the case where there is no print instruction in S205, a value of tn−tm is calculated and is judged as to whether or not the value is not less than 1 minute (S206). In the case where the value of tn−tm is not less than 1 minute in S206, the procedure is returned to S203 in which the value RH is calculated again. On the other hand, in the case where the value of tn−tm is less than 1 minute in S206, the value RH is not calculated again and the procedure is returned to S204 in which the image forming apparatus is placed in a print stand-by state.

In the case where judgment that the print instruction is provided is made in S205, values of high-voltage biases to be applied to the primary charger 21 and the developing sleeve 3 are set so that the value of Vcont equals to the value of Vcont 1 (S207). Then, at this setting of the value Vcont, the exposure by the exposure device 22 is effected on the basis of the γ look-up table selected as described above, so that image formation for one page is effected (S208). Next, different from the above-described reference example, in this specific example, the drive of the developing device 1 is detected and the time constant β is set at βp=5 minutes (S209). Then, first whether or not the image formation for one page is completed is judged and then whether or not the job is ended is judged (S210). In the case where the job is not ended is judged in S210, the value RH is calculated again (S211).

An exponential function approximation expression in this embodiment is as follows.

$$RH(\%)=(RHm-RHn)\times\exp(-(tn-tm)/\beta p)+RHn \quad (5)$$

Here, a difference between tn and tm is calculated in units of 0.01 minute, and βp which is a time constant of the exponential function is 5 minutes.

Next, a value Vcont2 corresponding to the newly calculated value RH is selected (S212).

Further, at the same time, the relative humidity data RHm stored in the data memory 303 of the main assembly controller 301 is updated to the newly calculated value RH and then is stored.

Next, whether or not the called-up value Vcont2 is equal to the value, Vcont1 is judged (S213). In the case where the value Vcont2 is judged as being equal to the value Vcont1 in S213, the value of Vcont is kept at Vcont1 and the γ look-up table based on the newly calculated value RH is selected (S214), and the procedure is returned to S208 in which subsequent image formation is effected. On the other hand, in the case where the value Vcont2 is judged as being changed from the value Vcont1 in S213, the value of Vcont1 is replaced with the value Vcont2 (S215), and the γ look-up table based on the newly calculated value RH is selected (S216). Then, the procedure is returned to S207 in which the high-voltage bias values are set again so that the value of Vcont equals the newly replaced value of Vcont1.

Operations in the above-described steps S207 to S216 are repeated until one job is ended. Further, in the case where the job is judged as being ended in S210, and then whether or not the power source of the apparatus main assembly A is turned off is judged (S217). Thereafter, the procedure is returned to S202 unless the power source is judged as being turned off in S217. Then, the step of the drive of the developing device 1 is detected and the time constant β is set again at βw=240 minutes and subsequent processing is repeated.

Incidentally, in this embodiment, the value Vcont in each environmental section was fixed at a predetermined value. However, the value Vcont may also be calculated by complementing an intermediate value of each value Vcont depending on the value RH. In this case, whether or not the change in Vcont exceeds a certain value may be checked in a step corresponding to S213. Further, in this embodiment, the plurality of γ look-up tables in the respective environmental sections were prepared and were selectively used. However, in order to reduce the amount of storage of the ROM, a single γ look-up table is prepared for the respective environmental sections and may also be changed by performing multiplication of a predetermined ratio or by adjusting a difference.

As described above, according to this embodiment, similarly as in Embodiment 1, it is possible to effect the control with high accuracy by accurately grasping the developer humidity control behavior during the drive and stop of the drive of the developing device. As a result, it is possible to meet the high required level in recent years with respect to the stability of density and color.

Embodiment 3

Next, another embodiment according to the present invention will be described. Basic constitution and operation of an image forming apparatus in this embodiment are identical to those in Embodiment 1. Accordingly, elements having functions and constitutions identical or corresponding to those in Embodiment 1 are represented by the same reference numerals or symbols and will be omitted from detailed explanation. In the following, a point different from Embodiment 1 will be principally described.

First, in this embodiment, with respect to each image forming portion 10, the drive of the developing sleeve 3 and the drive of the first and second screws 13 and 14 are independent from each other, so that the developing sleeve 3 and the first and second screws 13 and 14 can be independently actuated. Then, when the power source of the apparatus main assembly A is turned on, whether or not the value ABSn calculated from the detection result of the temperature/humidity sensor 51 at the time when the power source is turned on is changed by a predetermined value or more with respect to the value ABSm stored at the time of the last turning-off of the power source of the apparatus main assembly A is judged when the power source of the apparatus main assembly A is turned on. Then, in the case where the value ABSn is changed by the predetermined value or more, the developer inside the developing container 2 is stirred by rotating only the first and second screws 13 and 14 without rotating the developing sleeve 3, so that the ambient humidity at the periphery of the developer is mixed with that at the periphery of the image forming apparatus 100. In this case, the reason why the developing sleeve 3 is not rotated is that stress exerted on the developer by layer thickness regulation is alleviated as much as possible.

Thus, in this embodiment, the image forming apparatus 100 is operable in a screw drive mode in which only the first and second screws 13 and 14 are rotated. Further, a time constant as for calculating the value ABS adapted in this screw drive mode is set. In this embodiment, the time constant was set at αs=30 minutes.

Figure 9:
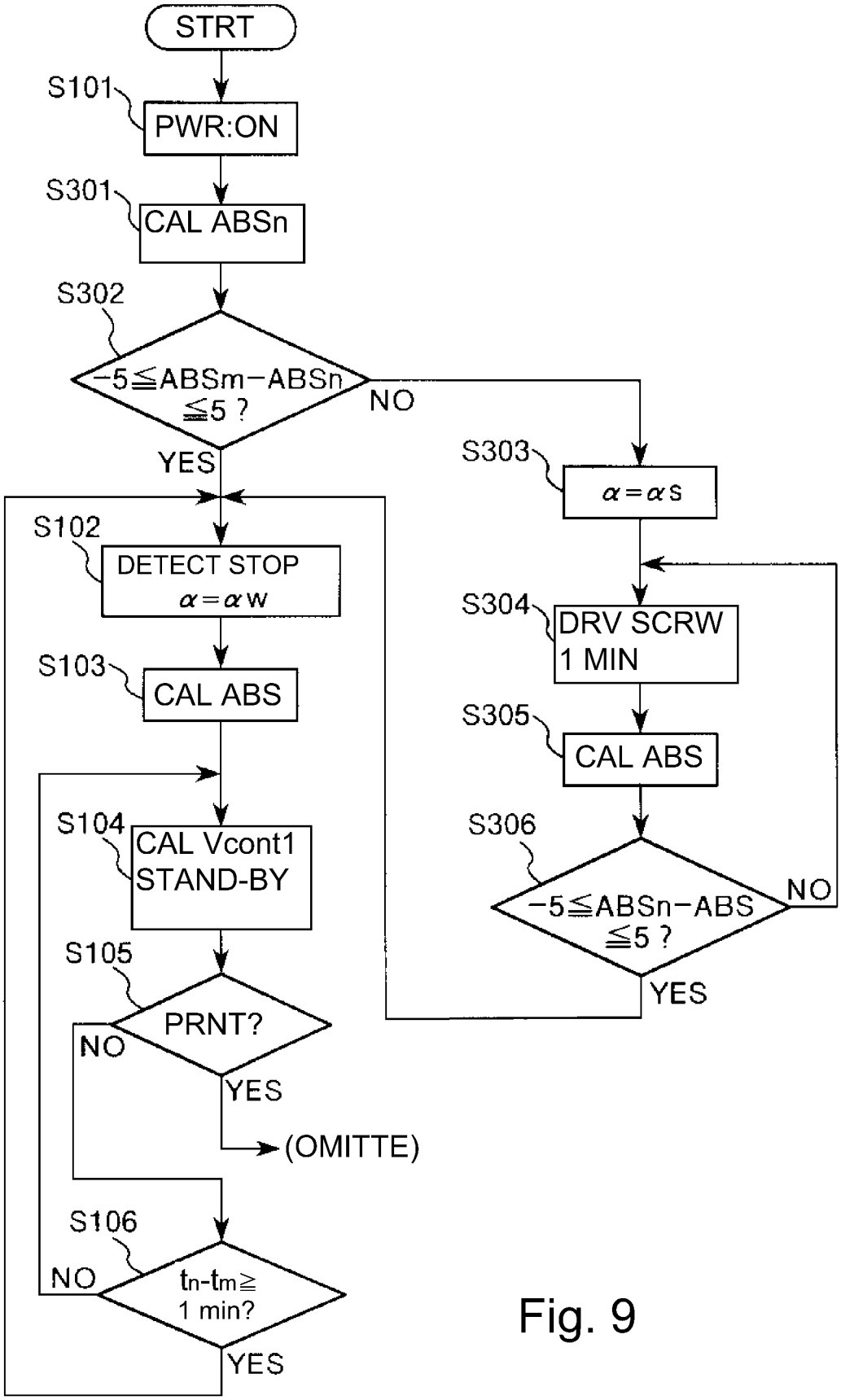
FIG. 9 is a flow chart of a further example of the image forming condition control in accordance with the present invention.

FIG. 9 shows a flow chart of the control in this embodiment. Incidentally, the operations identical to those in the steps in the flow chart of FIG. 3 are represented by the same step numbers.

First, the power source of the apparatus main assembly A is turned on (S101). Immediately after the turning-on of the power source, the value ABSn is calculated (S301). Then, an absolute value of the difference (ABSm−ABSn) is judged as to whether or not the absolute value is 5 (g/m$^3$) or less (S302).

In the case where the absolute value is judged as being 5 ($g/m^3$) or less in S302, the procedure goes to S102 and subsequent processing is performed in the same manner as in S102 to S115 in FIG. 5. On the other hand, in the case where the absolute value is judged as being not 5 ($g/m^3$) or less in S302, the time constant $\alpha$ is set at $\alpha s$=30 minutes (S303). Then, an operation in the screw drive mode (in which only the first and second screws 13 and 14 are rotated without rotating the developing sleeve 3) is executed for 1 minute (S304). At the time when this operation is ended, the value ABS is calculated (S305). Further, at this time, the absolute water content data ABSm stored in the data memory 303 of the main assembly controller 301 is updated to the newly calculated value ABS and is stored. Next, whether or not an absolute value of a difference between the newly calculated value ABS and the value ABSn calculated during the turning-on of the power source of the apparatus main assembly A is 5 ($g/m^3$) or less is judged (S306). In the case where the absolute value is judged as being 5 ($g/m^3$) or less in S306, the procedure goes to S102 and subsequent processing is performed in the same manner as in S102 to S115 in FIG. 5. Further, in the case where the absolute value is judged as being not 5 ($g/m^3$) or less, the procedure is returned to S304.

Thus, in the case where the ambient humidity of the image forming apparatus 100 is, during the turning-on of the power source, largely different from that at the time of the last use, the ambient humidity of the developer can be quickly brought near to the current ambient humidity of the image forming apparatus 100, so that the resultant image density can be further stabilized.

Further, in this embodiment, depending on the calculated value ABS, the primary transfer bias to be applied to the primary transfer roller 23 is also controlled. Specifically, a primary transfer bias look-up table is stored in advance in the ROM 304 and at the same time as timing of reading from a Vcont look-up table, an optimum primary transfer bias (electric) current value is selected from the primary transfer bias look-up table. Then, the primary transfer bias is controlled so as to be equal to the selected primary transfer bias (electric) current value. The control of the current value may be effected by an electric circuit capable of constant-current control or may also be effected by measuring a current passing through a constant-voltage circuit in advance and then by controlling a voltage value so that the current can flow. As a result, it becomes possible to more properly meet a change in transfer characteristic due to the change in toner charge amount.

As described above, according to this embodiment, it is possible to achieve effects similar to those in Embodiments 1 and 2 and it is possible to further improve the stability of the image density after the power source is turned on.

Embodiment 4

Next, another embodiment according to the present invention will be described. Basic constitution and operation of an image forming apparatus in this embodiment are identical to those in Embodiment 2. Accordingly, elements having functions and constitutions identical or corresponding to those in Embodiment 2 are represented by the same reference numerals or symbols and will be omitted from detailed explanation. In the following, a point different from Embodiment 1 will be principally described.

Figure 10:
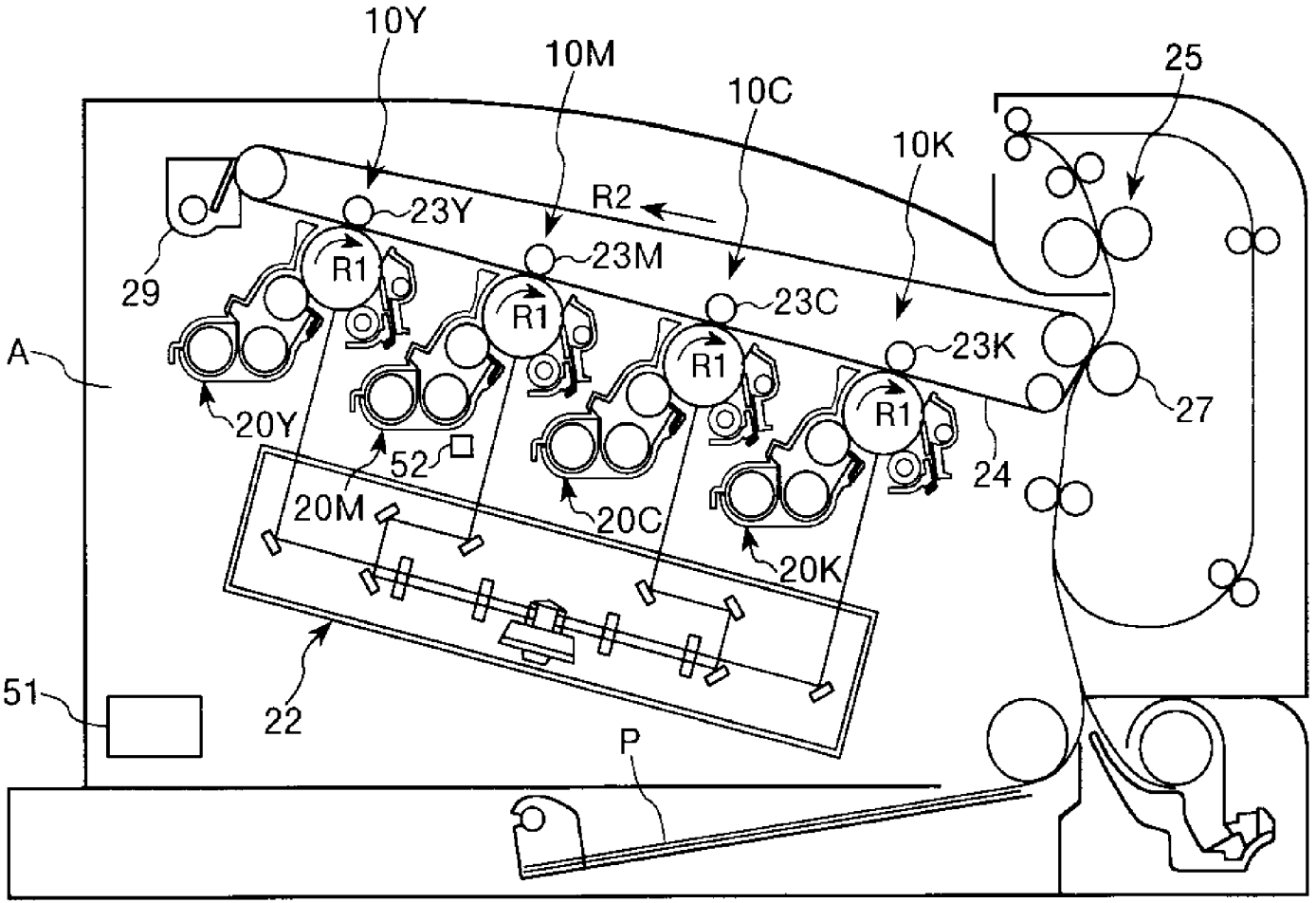
FIG. 10 is a schematic sectional view of an image forming apparatus according to another embodiment of the present invention.

First, in this embodiment, as shown in FIG. 10, a temperature sensor 52 is provided in the neighborhood of the drum cartridge.

Further, the two-component driver used in this embodiment is somewhat different in composition from that used in Embodiment 2 and therefore the charge amount of the toner depends on not only the relative humidity but also the temperature. For this reason, the temperature in the neighborhood of the developer is actually measured by using the temperature sensor 52 and from its result and the estimated relative humidity value, the calculation of the value Vcont and the selection of the $\gamma$ look-up table are effected. That is, the image forming condition is determined by using the actually measured temperature data in addition to the result of the humidity estimation control. For that reason, the stability of the image density is further increased.

Incidentally, as in this embodiment, the present invention is not limited to the constitution in which the temperature sensor 52 is disposed in the neighborhood of the drum cartridge but may also employ a constitution in which temperature sensors 52 are disposed at proper positions such as on outer walls of the developing containers 2 for the respective colors.

Other Embodiments

In the above, the present invention is described based on the specific embodiments but is not limited to the constitutions in Embodiments 1 to 4 described above.

For example, in Embodiments 1 to 4, the image forming condition controlled in accordance with the present invention was the developing contrast Vcont, the exposure amount of the exposure device or the transfer bias. However, the present invention is not limited thereto. The image forming condition to be changed includes at least one image formation parameter selected from the surface potential of the photosensitive member, the exposure amount of the exposure device, the DC component of the developing bias, the AC component of the developing bias, the transfer bias voltage, the transfer bias current and a difference between the DC component of the developing bias and the surface potential of the photosensitive member.

For example, as the control of the image forming condition, it would be considered that the image density is adjusted by changing the AC component (amplitude, waveform, frequency or the like) of the developing bias depending on the measurement result of the temperature/humidity sensor.

However, when parameter values to be changed in the cases where the developing device is not driven and is driven are taken as Pw and Pp, respectively, these parameter values may preferably satisfy the following formula:

$$1.5\times Pw \leq Pp \leq 100\times Pw \quad (6).$$

Examples of the parameter values Pw and Pp may include the developing contrast Vcont, the time constants at the time of obtaining the values ABS and RH and the exposure amount of the exposure device as the result of application of the $\gamma$ look-up table.

Generally, in the above formula (6), when the volume of the developer in the developing device is small (e.g., when the amount of the developer is about 50 g or less), the relationship between Pw and Pp approaches the left-side condition and when the volume of the developer is large (e.g., when the amount of the developer is about 2000 g or more), the relationship between Pw and Pp approaches the right-side condition. This is because, compared with the case where the developing device is driven, in the case where the volume of the developer at rest is large and the surface area is small, the humidity control does not readily proceed and therefore the difference in humidity control speed between the cases where the developing device is driven and is not driven becomes large. The humidity control speed also varies depending on a ratio between the volume of the developer and the surface area of the developer, thus depending on the constitution of the developing device. However, when Pp<1.5×Pw is satisfied, a difference in time constant between the cases where the developing device is driven and is not driven becomes small, so that the effect of the present invention becomes small. Further, when Pp>100×Pw is satisfied, the image forming condition control using the environmental history information when the developing device is not driven becomes excessively slow or that when the developing device is driven becomes excessively fast, thus being not preferable.

According to the present invention, it becomes possible to effect the image forming condition control with high accuracy by taking into consideration the developer humidity control behavior during the drive and stop of the drive of the developing device.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 122133/2010 filed May 27, 2010, which is hereby incorporated by reference.

What is claimed is:

1. An image forming apparatus comprising:

an image bearing member for bearing an image;

a developing device for developing with a toner an electrostatic image formed on said image bearing member;

a detecting portion for detecting environmental information;

a storing portion for storing the environmental information; and a controller for controlling an image forming condition on the basis of the environmental information detected in a last detection and current detection, wherein said controller controls the image forming condition so that a change amount per unit time of the image forming condition when said developing device is driven is made larger than a change amount per unit time of the image forming condition when said developing device is stopped.

2. An image forming apparatus according to claim 1, wherein the environmental information is a temperature or a humidity.

3. An image forming apparatus according to claim 1, wherein the image forming condition is a potential difference between an image forming portion potential and a DC voltage applied to said developing device.

4. An image forming apparatus according to claim 1, wherein said controller is capable of changing the image forming condition on the basis of a predetermined relational expression, and wherein said controller changes the predetermined relational expression on the basis of a driving condition of said developing device.

5. An image forming apparatus comprising:

an image bearing member for bearing an image;

a developing device for developing with a toner an electrostatic image formed on said image bearing member;

a detecting portion for detecting environmental information;

a storing portion for storing the environmental information; and a controller capable of controlling, on the basis of the environmental information detected in a last detection and current detection when the environmental information detected by said detecting portion is changed, an image forming condition so as to be gradually changed from the image forming condition set before the change in environmental information toward the image forming condition corresponding to the image forming condition after the change in environmental information, wherein when the image forming condition is changed, said controller controls the image forming condition so that a change amount per unit time of the image forming condition when said developing device is driven is made larger than a change amount per unit time of the image forming condition when said developing device is stopped.

6. An image forming apparatus according to claim 5, wherein the image forming condition is a potential difference between an image forming portion potential and a DC voltage applied to said developing device.

7. An image forming apparatus according to claim 5, wherein said controller is capable of changing the image forming condition on the basis of a predetermined relational expression, and wherein said controller changes the predetermined relational expression on the basis of a driving condition of said developing device.

8. An image forming apparatus according to claim 5, wherein said developing device includes a stirring member for stirring a developer therein, and wherein the driving information of said developing device is the driving information of said stirring member.

9. An image forming apparatus comprising:

an image bearing member for bearing an image;

a developing device for developing with a toner an electrostatic image formed on said image bearing member;

a detecting portion for detecting environmental information;

a storing portion for storing the environmental information; and a controller capable of controlling, on the basis of the environmental information detected in a last detection and current detection when the environmental information detected by said detecting portion is changed, an image forming condition so as to be gradually changed from the image forming condition set before the change in environmental information toward the image forming condition corresponding to the image forming condition after the change in environmental information, wherein when the image forming condition is changed, said controller controls, on the basis of the environmental information detected in the last detection and the current detection, an image forming condition so that a change amount per unit time of the image forming condition during an image forming operation is made larger than a change amount per unit time of the image forming condition from an end of a last image formation to start of a current image formation.

10. An image forming apparatus according to claim 9, wherein the image forming condition is a potential difference between an image forming portion potential and a DC voltage applied to said developing device.

11. An image forming apparatus according to claim 9, wherein said controller is capable of changing the image forming condition on the basis of a predetermined relational expression, and wherein said controller changes the predetermined relational expression on the basis of a driving condition of said developing device.

12. An image forming apparatus according to claim 9, wherein said developing device includes a stirring member for stirring a developer therein, and wherein the driving information of said developing device is the driving information of said stirring member.

13. An image forming apparatus comprising:

an image bearing member for bearing an image;

a developing device for developing with a toner an electrostatic image formed on said image bearing member;

a detecting portion for detecting environmental information;

a storing portion for storing the environmental information; and a controller for controlling an image forming condition on the basis of the environmental information detected at different times, wherein said controller controls the image forming condition on the basis of humidity information changed with predetermined time constants from first humidity information obtained from first environmental information detected by said detecting portion in a last detection toward second humidity information obtained from second environmental information detected by said detecting portion in current detection, and wherein the time constants when said developing device is driven are larger than the time constants when said developing device is not driven.

* * * * *